United States Patent [19]

Meyer

[11] 4,152,552

[45] May 1, 1979

[54] HORN SPEAKER AND METHOD FOR PRODUCING LOW DISTORTION SOUND

[76] Inventor: John D. Meyer, 1531 Posen Ave., Albany, Calif. 94706

[21] Appl. No.: 871,708

[22] Filed: Jan. 23, 1978

Related U.S. Application Data

[63] Continuation-in-part of Ser. No. 764,596, Feb. 1, 1977, abandoned.

[51] Int. Cl.[2] ..... H04R 1/30; H04R 9/06

[52] U.S. Cl. ..... 179/115.5 H; 181/159

[58] Field of Search ..... 179/115.5 H; 181/159

[56] References Cited

U.S. PATENT DOCUMENTS

| | | | |
|---|---|---|---|
| 1,713,006 | 5/1929 | Round | 179/115.5 R |
| 1,759,725 | 5/1930 | Young et al. | 179/115.5 R |
| 1,917,012 | 7/1933 | Blattner | 179/115.5 H |
| 2,037,185 | 4/1936 | Thuras | 179/115.5 H |
| 2,568,883 | 9/1951 | Carrington | 179/115.5 H |
| 2,907,837 | 10/1959 | Brami | 179/115.5 H |
| 4,017,694 | 4/1977 | King | 179/115.5 VC |

*Primary Examiner*—George G. Stellar
*Attorney, Agent, or Firm*—Bruce & McCoy

[57] ABSTRACT

An acoustical horn speaker for producing low distortion sound comprised of a casing assembly having a voice coil gap and a magnetic source and return circuit for providing a constant magnetic field across the gap, a current-carrying voice coil disposed in said gap, and a voice diaphragm in rigid attachment with the voice coil, said voice diaphragm being suspended from the casing assembly by a relatively flexible, high compliance suspension member. An acoustical horn having a throat resistance sufficiently high to substantially dominate the radiation resistance of the diaphragm is air coupled at its throat end to the voice diaphragm suspended from said casing, while the compliance of the voice diaphragm suspension is relatively high such that in the presence of the dominating throat resistance of the horn the diaphragm vibratory movement is characterized by substantially force determinative excursions as opposed to substantially linear constant displacement excursions.

A method of producing low distortion sound in a horn type speaker comprising the step of driving the speaker's diaphragm in a vibratory movement characterized by substantially force determinative excursions as opposed to substantially linear constant displacement excursions.

19 Claims, 3 Drawing Figures

HORN SPEAKER AND METHOD FOR PRODUCING LOW DISTORTION SOUND

CROSS-REFERENCE TO RELATED APPLICATIONS

This is a continuation-in-part of U.S. Pat. Application Ser. No. 764,596 filed Feb. 1, 1977, now abandoned.

BACKGROUND OF THE INVENTION

1. Field of the Invention

The present invention relates generally to audio speakers, and more particularly to horn type speakers and compression drivers for driving same at high audible levels, typically in the range of 90 to 120 db.

2. Description of the Prior Art

Acoustical speakers fall into two basic design categories: First, there is the less expensive so-called direct radiator type speaker wherein the speaker diaphragm is coupled directly to atmosphere; secondly, there is the horn or the horn type speaker wherein a so-called compression driver is used having a diaghragm coupled to atmosphere indirectly through an acoustical horn. Horns, the designs of which are well known and are described in detail in Beranek, *Acoustics*, McGraw-Hill, 1954, at pages 268 to 284, act as a transformer between the voice diaphragm of the compression driver and atmosphere, and are characterized by high efficiency in transmitting acoustical power to the listening area. Direct radiators, on the other hand, are characterized by low efficiency, and this quality plus the direct radiator's lack of directivity makes them impractical for use in sound systems requiring high audible levels. Thus, in PA systems and other systems with high sound pressure level requirements, horn type speaker systems are employed.

Unfortunately, conventional horn type speakers introduce significant distortion at high output levels which is perceived by the listener as a lack of quality and clarity of the sound. Thus, one's normal experience in listening to a PA system is that the sound while intelligible is not pleasing in its reproduction when contrasted, for example, with the high fidelity sound from a conventional home stereo. It is believed that the high distortion of a conventional horn speaker is caused in most part by the relatively low compliance of the conventional driver's diaphragm suspension (relative low compliance is characterized by relative stiffness). Because of this low compliance suspension, which typically ranges in conventional designs between $6\times10^{-6}$ meters/newton to $4\times10^{-5}$ meters/newton, the diaphragm vibrates substantially in a constant displacement mode making it analogous to a constant current source in an electrical system whose output ignores variations in load impedence. While such constant displacement motion enhances the system's frequency response because it tends to overcome impedance mismatches in the system, it also produces nonlinear behavior in the sound pressure wave. This nonlinear behavior becomes quite apparent in conventionally designed compression drivers since the conventional compression driver utilizes a back cap nested closely behind the voice diaphragm for the purpose of boosting high frequency response.

To understand the nonlinear behavior of the sound pressure wave generated by a diaphragm operating in a constant displacement mode, one must first consider that the diaphragm loaded by the throat of the horn acts somewhat like a piston in a closed container. For adiabatic expansions which are known to occur between 10 Hz to 20,000 Hz, the relation between the total pressure and volume in the container is expressed by Boyle's law:

$$PV^{r}=\text{constant}$$

where r is the ratio of the specific heat of the gas at constant pressure to the specific heat at constant volume for the gas. As the piston reciprocates with constant displacement on either side of a fixed reference, the peaks and valleys of the air pressure wave, which for linearity would show equal pressure deviations, are distorted or unequal because of the disproportionate changes in volume as the piston first moves toward the container's closed end and then by an equal distance away from it. This phenomena tends to flatten the pressure deviation or wave in the negative excursion; this introduces a consequent nonlinearity to the system which in turn gives rise to distortion.

The present invention overcomes the distortion problems of conventional compression drivers by providing a driver mechanism which substantially eliminates the nonlinearities in the sound pressure wave produced by conventional constant displacement driver mechanisms. Such low distortion operation is achieved, in addition, without significant degredation of the overall frequency response of the speaker system.

SUMMARY OF THE INVENTION

The present invention is a low distortion horn speaker comprised of a casing assembly and an acoustical horn having a mouth end and a throat end. A voice diaphragm is disposed in the casing assembly so as to air couple to the throat end of the horn with the throat end of the horn being sized to provide a throat resistance which substantially dominates the radiation resistance of the diaphragm over the operating range of the speaker. A diaphragm suspension means for suspending the diaphragm from the casing assembly is designed to have a relatively high compliance wherein the vibratory movement of the diaphragm in the presence of the substantially dominating throat resistance of the speaker's acoustical horn is characterized by substantially force determinative excursions as opposed to substantially linear constant displacement excursions. Means are provided in the speaker for imparting vibratory movement to the diaphragm in response to an externally supplied audio frequency electrical signal.

The invention also includes a separate low distortion compression driver for an acoustical horn speaker comprised of a casing assembly adapted to be secured to a mouth end section of an acoustical horn. The casing assembly has an air passage means which forms the throat end of an acoustical horn with the air passage means sized to provide a horn throat resistance which substantially dominates the radiation resistance of the diaphragm suspended from the speakers casing assembly. The diaphragm suspension means is designed with a relatively high compliance such that in the presence of the substantially dominating throat impedance the vibratory movement of the diaphragm is characterized by substantially force determinative excursions as opposed to substantially linear constant displacement excursions.

The invention further includes a method of producing low distortion sound from an acoustical horn speaker having a voice diaphragm air coupled to the throat end of the speaker's horn. The method comprises the step of driving the voice diaphragm in a vibratory motion characterized by substantially force determinative excursions as opposed to substantially constant displacement excursions.

OBJECTS OF THE INVENTION

It is therefore an object of the present invention to provide an acoustical horn speaker which has low distortion at high sound pressure levels.

It is another object of the present invention to provide a low distortion acoustical horn speaker wherein low distortion is achieved without introducing significant degredation in the overall frequency response which cannot be electronically compensated for.

It is a further object of the present invention to provide a separate low distortion compression driver adapted to be secured to a horn attachment for providing a horn speaker having low distortion at high sound pressure levels.

It is still another object of the present invention to provide a method for reproducing low distortion sound at high sound pressure levels.

It is still another object of the present invention to provide a low distortion compression driver for an acoustical horn speaker which will provide high quality public address systems with components of manageable size.

Yet another object of the invention will become apparent in the following specification and claims.

DESCRIPTION OF THE PREFERRED EMBODIMENT

Figures 1, 2, 3:
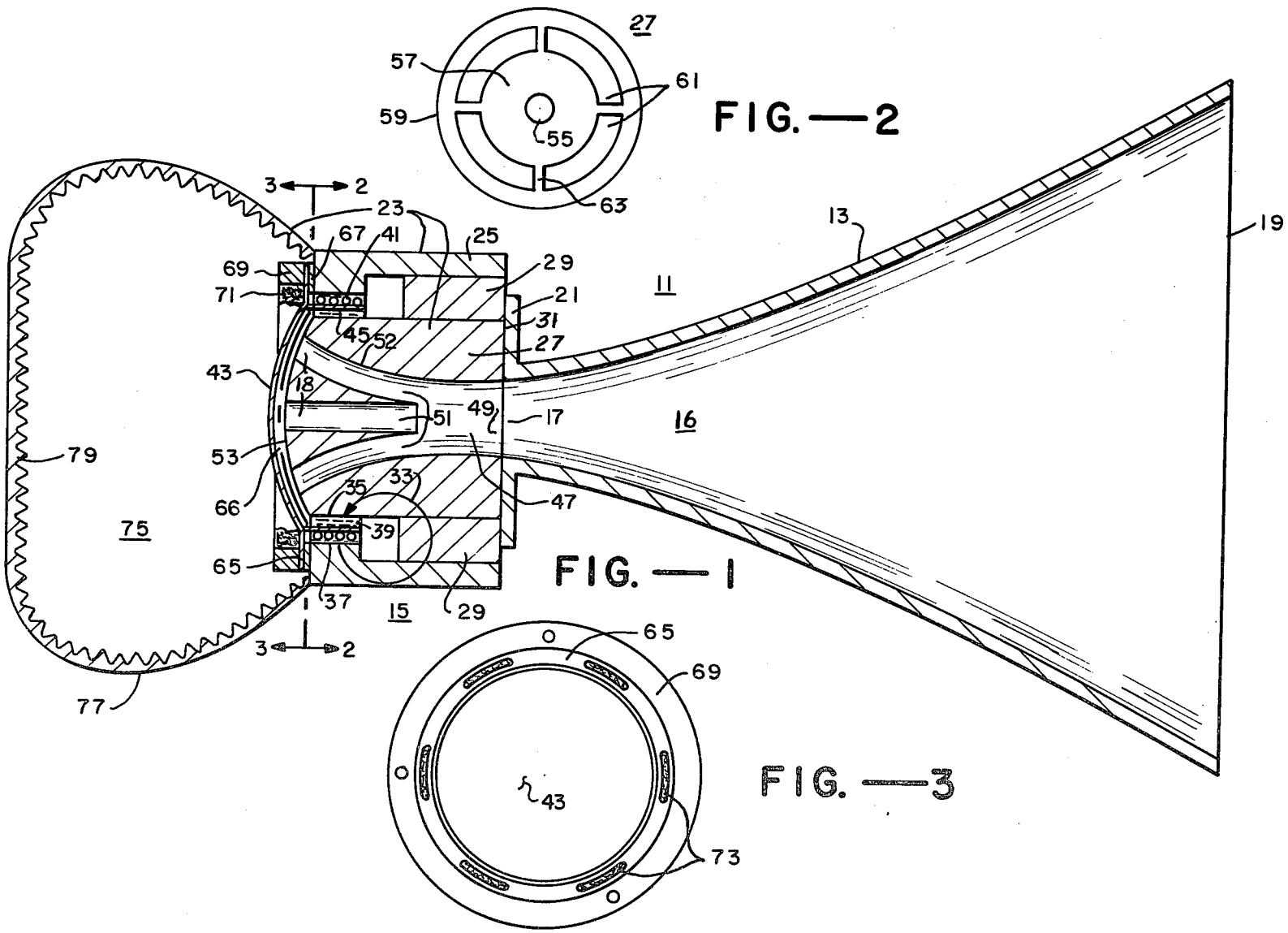
FIG. 1 of the drawings is a cross-sectional view in pictorial representation of a horn speaker constructed in accordance with the present invention.
FIG. 2 is a cross-sectional view of the horn speaker shown in FIG. 1 taken along lines 2—2.
FIG. 3 is a cross-sectional view of the driver shown in FIG. 1 taken along lines 3—3, and is specifically intended to show the voice diaphragm and diaphragm suspension member in front view.

The present invention is an acoustical horn speaker which permits high quality, low distortion audible sound to be reproduced at high sound pressure levels. The speaker features a driver mechanism which acts to compensate for the inherent non-linear behavior in air pressure waves, behavior which gives rise to harmonic and intermodulation distortion in horn type speakers having conventional linearly acting voice diaphragms, that is, diaphragms which exhibit constant displacement in their vibratory excursions about a central reference plane. To achieve this the inventor, departing from engrained principles of horn speaker design, provides a diaphragm having a relatively flexible, high compliance suspension in the presence of an acoustical horn having a substantially dominating throat impedance over the speakers operating range. Thus, unlike and in constrast to conventional horn speakers, where the design principle is to match impedance as closely as possible, it is important to the present invention that there be an impedance mismatch at the throat of the horn.

Referring now to the drawings, FIG. 1 shows a cross-sectional view in pictorial form of an acoustical horn speaker showing the mouth end section 13 of an acoustical horn attached to a compression driver 15. It is noted that in the driver there is an air passage means 47 which communicates with the mouth end attachment 13 so as to form a continuous air passageway 16 having a throat end 18 which opposes the speaker's voice diaphragm 43, and a mouth end 19 which is open to the outside listening area. When talking of "speaker horns", reference is commonly made to a horn attachment such as element 13 in FIG. 1, however, for the purpose of discribing the present invention the acoustical horn of the speaker shall be defined as the full length of the air passageway 16 from its diaphragm opposing throat end 18 to its mouth end 19. It is contemplated that the present invention would include speaker embodiments wherein the horn 13 is manufactured as an integral part of the speaker, or wherein a horn attachment defines the entire acoustical horn. The latter embodiment would require the suitable positioning of the speaker's diaphragm to the front of the compression driver. In FIG. 1 the horn attachment 13 which flares from a narrow end 17 to the substantially wider mouth 19 is shown as being attached to driver 15 by means of a flange 21. However, other horn attachment securement means could be used and would be well known to persons skilled in the art.

Driver 15 consists of a casing assembly 23 which includes outer housing 25 which surrounds an internally disposed phasing plug 27; both the housing and plugs are preferably fabricated from a magnetic material. A source of magnetic flux is shown in the form of permanent magnet 29 which has an annular shape and surrounds the throat end 31 of the phasing plug 27 between the phasing plug and outer housing 25. As shown by arrow 33, the casing assembly provides a magnetic return circuit for the source of magnetic flux provided by annular permanent magnet 29. In a conventional manner, the magnetic return circuit terminates in closely opposed surfaces 35, 37 which form a gap 39. A constant magnetic field is seen across gap 39 because of the magnetic flux source and the provided magnetic return circuit. It is understood that it is only essential to the invention to provide a suitable gap having a constant magnetic field, and that a different design or configuration of the casing assembly can be employed for this purpose. For example, instead of permanent magnet 29 as a source of magnetic flux a field coil might be used with a suitable magnetic return circuit being provided through the casing assembly between the opposed surfaces of the gap. In fact, the casing design of many conventional compression drivers would be compatible with the concept of the present invention.

Gap 39 is preferably annular and in the embodiment shown in the drawings surrounds the phasing plug 27 with the gap's surfaces being provided by a portion of the phasing plug and an extension of outer housing 25. A voice coil 41 is disposed in the gap 39 and is rigidly connected to voice diaphragm 43 by means of annular sleeve 45 which depends from the diaphragm into the gap. In FIG. 1, the voice coil is shown as being wound around sleeve 45, but the sleeve, preferably a suitable plastic material, could have the voice coil molded into it. To prevent distortion, it is important that the voice coil be centered within the gap such that during a maximum excursion of the voice coil the entire voice coil always sees a constant magnetic field. Of course, the voice coil would have electrical leads (not shown) which would be externally accessible for receiving the output from an audio amplifier.

Voice diaphragm 43, which preferably has a dome shape, is located directly behind and opposed to air passage means 47 which as above described combines with horn mouth end section 13 to form the speaker's acoustical horn 16. As shown, in its preferred configuration the air passage means 47 extends through phasing plug 27, so called because the phasing plug has a plurality of phasing air channels 51 substantially spaced apart at the diaphragm end 53 of phasing plug 27. From the diaphragm end 53 of plug 27, the air channels 51 converge to a common air passage 49 which, in turn, is air coupled to the narrow end 17 of horn attachment 13. The separate converging air channels 51 act to prevent the audio air pressure waves generated by the vibratory motion of diaphragm 43 from cancelling as the waves are focused to the throat of the horn.

The separate converging air channels 51 are, importantly, also relatively small in cross-sectional area. Since the real part of the throat impedance of the overall acoustical horn 16 is inversely related to the horns throat area, the relatively small air channels 51 provide a relatively high horn throat impedance. The throat impedance and hence the throat size of the horn is chosen to be small such that the throat impedance will substantially dominate the radiation resistance of the speaker's diaphragm 43 over the operating range of the speaker. The radiation resistance of the diaphragm 43, which as below described has a relatively flexible high compliance suspension, can be approximated by the radiation resistance of a circular piston mounted in an infinite baffle in air, a resistance which is charted in Massa, *Acoustic Design Charts,* Blakiston Company, 1942, and which increases with frequency. The operating range of the speaker will essentially be limited at the high frequency end by the increase with frequency of the diaphragms radiation resistance to a level wherein the horns throat resistance, which is frequency insensitive, no longer dominates. With this principle in mind a suitable horn design can be empirically arrived at. The size of the horns throat will affect the high end of the speakers operating range in terms of acceptable distortion levels and the horn's cutoff frequency will define the low end of the range.

The configuration of the phasing plug shown in FIGS. 1 and 2 is illustrative only for other designs would be suitable should a phasing plug be used having suitable throat impedance characteristics. The particular phasing plug shown consists of a conical spider element 57 secured in the flared central bore 52 of the phasing plug body 59; the spider element 57, in turn, has its own central bore 55 which forms one of the phasing air channels 51, with four additional arcuate phasing channels 61 being formed between the legs 63 of spider element 57. As shown in FIG. 1, it is clear that a suitable air space 66 will be required between the diaphragm 43 and the diaphragm end 53 of the phasing plug so as to permit relatively free excursions of the diaphragm in the direction of the phasing plug during the diaphragm's vibratory movement. It has been found that the amount of distortion in the speaker is sensitive to the size of this air space and that the spacing between diaphragm 43 and the diaphragm end 53 of phasing plug 27 has to be carefully adjusted for the best results.

Important to the concept of the present invention is the diaphragm suspension. The diaphragm 43 is suspended from the casing assembly 23 by a diaphragm suspension means preferably consisting of an annular diaphragm suspension member 65 secured at its outer diameter to the outer housing 25 of the casing assembly. As shown, the periphery of the dome shaped diaphragm is secured to the inside diameter of the suspension member 65 with sleeve 45 depending approximately from the junction of the diaphragm and suspension member. The diaphragm is mounted to the casing assembly by sandwiching the outer diameter of suspension member 65 between two keeper rings 67, 69 thereby forming a generally rigid diaphragm voice coil sub-assembly which can be easily attached or detached from the casing assembly by screws (not shown) or other suitable fastening means. Since the voice coil 41 is part of the separately detachable diaphragm sub-assembly, it is important that the fastening means be carefully aligned to close tolerances to provide accurate centering of the voice coil in gap 39.

The diaphragm-voice coil sub-assembly shall additionally preferably consist of an annular sound absorbing element 71 fitted about the inner diameter of keeper ring 69. It has been discovered that such a sound absorbing element will dampen the high frequency response characteristics of the high compliance suspension member 65. As shown, sound absorbing element 71 should be wide enough to substantially cover suspension member 65.

The material and design of the diaphragm suspension member 65 is chosen to have a high compliance rating with a suitable compliance, depending on design, preferably being in a compliance range extending from about $4\times10^{-2}$ meters/newton to $4\times10^{-4}$ meters/newton. With such a high compliance suspension and a horn designed as herein described, it has been found that comparatively low distortion can be achieved for high sound pressure levels over 90 db. Moreover, this can be achieved while maintaining a satisfactory frequency response at sound pressure levels normally associated with high distortion. To achieve high compliance, the suspension member 65 can be fabricated from a soft rubber material or a compliant plastic material, such as a thin polyimide film, of a design which gives substantial flexibility within the indicated compliance range. The suspension member design shown in the figures contemplates a plastic material wherein material has been removed to increase the structure's compliance. The material removed from the suspension member 65 appears as a plurality of openings 73 which are evenly spaced about the suspension member as shown in FIG. 3.

Because of the diaphragm's high compliance suspension in the presence of a dominating horn throat impedance, the distance which diaphragm 43 moves from its relaxed position or central reference plane in each of its vibratory forward and backward excursions will tend to be goverened by the forces externally exerted on the diaphragm by the surrounding air. The diaphragm will thus seek its own displacement as determined by the operating forces on it and will as a result produce an air pressure wave having substantially equal pressure variations about the ambient pressure of the air medium (assuming of course an a.c. current of constant amplitude through the voice coil 41). This vibratory motion can be characterized in fewer words, and will herein be defined as, "force determinative" motion and is contrasted with constant displacement motion of conventional speaker diaphragms.

It is noted that conventional compression drivers for horns will have separate backing member, known as a back cap, closely nested behind the diaphragm to boost the high frequency response of the speaker. Such a back cap is included in the conventional designs to overcome the natural tendency of a horn to fall off at the high frequency end. The present invention, however, provides that such a back cap shall not be used, and that a large air space 75 shall be provided behind the diaphragm on the side looking away from the throat 18 of the horn 16. The air space 75 should be of a size substantial enough to permit free loadless displacement of the diaphragm during its backward excursion into that air space. It is believed that it enhances the linearity of the air pressure wave produced by the forward and backward excursions of diaphragm 43. Preferably, as part of the casing assembly, a relatively large back cover plate 77 is provided which is lined with a sound absorbant material 79 and which can be attached by any suitable means to the outer housing 25 of the casing assembly. The sound absorbing material lining back cover plate 77 will prevent undesirable reflections off the back cover plate and any consequent degredation of the driver's frequency response.

To overcome the tendency of the high frequency response of the present invention to fall off, a high frequency boosting circuit can be used in the amplifier circuit to boost the level of the high frequency signals inputted into the voice coil leads. Alternatively, a passive means can be used at the amplifier stage to compensate for the high frequency fall off. Further, it is important in the present invention to carefully design the horn to avoid mismatch at the mouth of the horn over the operating range of the speaker. This is important because reflections caused by mismatches at the horns mouth would introduce ripple into the horn's throat resistance which in turn would significantly and adversely affect the distortion characteristics and frequency response of the speaker. Using known horn design principles, such as those set forth by Don Keele, Jr., suitable impedance matching at the horn's mouth can be achieved to minimize horn mouth reflections and produce a relatively smooth throat resistance over the speaker's operating range.

To improve the overall performance of the driver of the present invention, the voice coil 41 is immersed in a magnetic fluid material suspended by magnetic forces in gap 39. Such a magnetic fluid material, which is commercially available, provides damping of the diaphragm system composed of diaphragm 43, sleeve 45, and the voice coil 41, and further provides for efficient dissipation of heat developed in the voice coil. The fluid can be injected into the gap of the casing assembly by any suitable syringe or eyedropper. The optimum viscosity of the magnetic fluid would depend on the design characteristics of the driver and could be chosen without undue experimentation.

As an example of the performance of a compression driver and horn constructed in accordance with the present invention, a unit of the following design was built (using a Model 808-8A Altec driver with a phasing plug of the design shown in FIGS. 1 and 2) and tested: A complex (exponential/conical) horn having a cutoff frequency of 1000 Hz, a mouth size of 6" (15.24 cm) by 8" (20.32 cm), a length of 9.32 inches (23.67 cm) and a total throat area measured at the diaphragm end of the phasing plug of approximately 0.18 sq. inches (1.16 sq. cm), was used with a driver having an aluminum dome diaphragm approximately 1.75 inches (4.45 cm) in diameter, suspended by a polyimide film suspension member having a compliance of about $1.0\times10^{-3}$ meters/newton. The phasing plug to diaphragm spacing was approximately 0.034 inches (0.086 cm). A ferrofluid (magnetic fluid) manufactured by Ferrofluidics Corporation and having a viscosity of 500 centipoise was used in the voice coil gap with the gap field measuring about 15,000 gauss. During test, the speaker was driven by a 60 watt power amplifier in conjunction with an equalization circuit having the following boosting characteristics:

| Frequency | db from 1600 Hz |
|---|---|
| 1600 Hz | 0 |
| 3000 | +4db |
| 6000 | +9db |
| 11,000 | +16db |
| 15,000 | +18db |
| 18,000 | +18db |

The test speaker as tested in an anechoic chamber at 1 meter on axis, yielded the following results for second and third harmonics.

| Freq. | 90 db spl | | 100 db spl | | 110 db spl | |
|---|---|---|---|---|---|---|
| (KHz) | 2nd | 3rd | 2nd | 3rd | 2nd | 34d |
| 1.6 | −45db | −55db | −45 db | −50db | −38db | −40db |
| 2.0 | −50 | −60 | −45 | −50 | −40 | −48 |
| 3.0 | −52 | −60 | −45 | −55 | −40 | −45 |
| 4.0 | −53 | −60 | −45 | −58 | −40 | −50 |
| 6.0 | −50 | −60 | −45 | −60 | −40 | −48 |
| 8.0 | −48 | −55 | −45 | −60 | −40 | −50 |
| 10.0 | −45 | −54 | −40 | −55 | −38 | −50 |

In addition to the above results, all two tone intermodulation products of 2000 Hz and 10,000 Hz were at least −50 db at 90 db spl.

The frequency response for the above test unit was ±2.5 db on axis over the indicate frequency range. The sound pressure level (SPL) 40° off axis was down −6 db from the on axis sound pressure level with the overall response being ±3 db for the same frequency range.

The present invention is a novel acoustical horn speaker and compression driver for same which employs a novel high compliance diaphragm suspension system in the presence of a dominating horn throat impedance for producing a low distortion acoustical sound wave at high sound pressure levels without significant degredation of the overall frequency response to the speaker. The invention also encompasses a method for producing low distortion sound at high sound pressure levels by driving a voice diaphragm in a vibratory motion characterized by substantially force determinative nonlinear excursions, as opposed to substantially linear constant displacement excursions.

While the preferred embodiment of the present invention has been described in considerable detail in the above specification, it is not intended that the invention be limited to such description, except as necessitated by the appended claims. It is specifically intended that all changes and modifications of the embodiment above described shall be covered which do not constitute departures from the spirit and scope of the invention.

What I claim is:

1. A method of producing low distortion sound from an acoustical horn speaker having a voice diaphragm air coupled to the throat end of the horn of said speaker comprising the steps of: actuating said voice diaphragm with a signal having frequency components which fall substantially within the frequency range of said horn speaker, permitting said voice diaphragm to move freely in response to said diaphragm actuating signal whereby the diaphragm's vibratory motion is characterized by substantially force determinitive excursions as opposed to substantially linear displacement excursions, and passing the air pressure waves produced by the vibratory motion of the diaphragm through the horn of said speaker wherein the throat end of said horn presents a throat resistance which substantially dominates the radiation resistance of said voice diaphragm substantially over the frequency range of said horn speaker.

2. A low distortion compression driver for an acoustical horn speaker comprising, a casing having an air passage means therein, said casing assembly being adapted to be secured to a mouth end section of a horn such that said horn mouth end section communicates with said casing assembly air passage means to define an acoustical horn which terminates in said casing assembly at a throat end, a voice diaphragm disposed in said casing assembly such that it is air coupled to the throat end of said horn, said throat end of said acoustical horn being sized to provide a throat resistance which substantially dominates the radiation resistance of said diaphragm substantially over the frequency range of said horn speaker, a diaphragm suspension means for suspending said diaphragm from said casing assembly, the compliance of said diaphragm suspension means being relatively high substantially over the frequency range of said speaker wherein, when said diaphragm is operating in the presence of the dominating throat resistance of said acoustical horn, any vibratory movement of said diaphragm, whether defined by one or more frequency components substantially within the frequency range of said speaker, is characterized by substantially force determinative diaphragm excursions as opposed to substantially linear, displacement excursions whereby the vibratory movement of said diaphragm tends to compensate for the non-linear behavior of air pressure waves otherwise produced by a linearly vibrating diaphragm thereby reducing distortion in said air pressure wave and hence in the sound produced thereby, and means for imparting vibratory movement to said voice diaphragm in response to an externally supplied audio frequency electrical signal.

3. The low distortion compression driver of claim 2 wherein an air space is provided on the side of the voice diaphragm opposite the throat of said acoustical horn, said air space being of a size substantial enough to permit substantially free loadless displacement of said diaphragm during a backward excursion thereof.

4. The low distortion compression driver of claim 2 wherein the compliance of said diaphragm suspension means is in a range generally between $4\times10^{-2}$ meters/newton to $4\times10^{-4}$ meters/newton.

5. The low distortion compression driver of claim 2 wherein said high compliance suspension means includes a substantially annular suspension member secured at its inner circumference about the periphery of said voice diaphragm and secured at its outer circumference to said casing assembly.

6. The low distortion compression driver of claim 5 wherein said high compliance suspension member is made of a soft rubber material.

7. The low distortion compression driver of claim 5 wherein said high compliance suspension member is made of a flexible plastic material.

8. The low distortion compression driver of claim 5 wherein said high compliance annular suspension member has material removed therefrom so as to form openings spaced about the annular suspension member's circumference whereby increased compliance of said suspension member is achieved.

9. A low distortion compression driver for an acoustical horn speaker comprising, a casing assembly having an air passage means therein, said casing assembly being adapted to be secured to a mouth end section of a horn such that said horn mouth end section communicates with said casing assembly air passage means to define an acoustical horn which terminates in said casing assembly at a throat end, a magnetic return circuit in said casing assembly, said magnetic return circuit terminating in closely opposed surfaces to form a gap therebetween, a magnetic flux source for inducing a constant magnetic field in said gap, a current carrying voice coil means disposed in said gap, a voice diaphragm rigidly connected to said voice coil means so that vibratory movement of said coil induced by varying current passed therethrough in the presence of said constant magnetic field imparts corresponding vibratory movement to said diaphragm, said voice diaphragm being air coupled to the throat end of said horn, said throat end of said acoustical horn being sized to provide a throat resistance which substantially dominates the radiation resistance of said diaphragm substantially over the frequency range of said horn speaker, a diaphragm suspension means for suspending said diaphragm from said casing assembly, the compliance of said diaphragm suspension means being relatively high substantially over the frequency range of said speaker wherein, when said diaphragm is operating in the presence of the dominating throat resistance of said acoustical horn, any vibratory movement of said diaphragm, whether defined by one or more frequency components substantially within the frequency range of said speaker, is characterized by substantially force determinative diaphragm excursions as opposed to substantially linear displacement excursions, whereby the vibratory movement of said diaphragm tends to compensate for the nonlinear behavior of air pressure wave otherwise produced by a linearly vibrating diaphragm thereby reducing distortion in said air pressure wave and hence in the sound produced thereby, and an air space on the side of said diaphragm opposite said air passage means, said air space being of a size substantial enough to permit substantially free loadless displacement of said diaphragm during a backward excursion thereof.

10. The low distortion compression driver of claim 9 wherein the compliance of said diaphragm suspension means is in a range generally between $4\times10^{-2}$ meters/newton to $4\times10^{-4}$ meters/newton substantially over the operating frequency range of said driver.

11. A low distortion compression driver for an acoustical horn speaker comprising, in combination, a casing assembly adapted to be secured to the mouth end section of an acoustical horn, said casing assembly being comprised of, an outer housing, a phasing plug surrounded by said outer housing, said phasing plug having an air passage means therein which communicates with said horn mouth end section when same is secured to said casing assembly wherein said air passage means and horn mouth end section define an acoustical horn which terminates in said casing assembly at a throat end, said outer housing and phasing plug having a magnetic return circuit terminating in closely opposed surfaces to form an annular gap therebetween, a magnetic flux source for inducing a constant magnetic field in said annular gap, a generally dome shaped voice diaphragm rigidly connected to said voice coil whereby vibratory movement of said voice coil induced by varying current passed therethrough in the presence of said magnetic field imparts a corresponding vibratory movement to said diaphragm, said voice diaphragm being disposed so that it is air coupled to the throat end of said acoustical horn, said throat end of said acoustical horn being sized to provide a throat resistance which substantially dominates the radiation resistance of said diaphragm substantially over the frequency range of said horn speaker, and a relatively high compliance annular diaphragm suspension member secured to the outer housing of said casing assembly for suspending said diaphragm between said phasing plug and the air space formed by said back cover, the compliance of said annular suspension member being relatively high substantially over the frequency range of said horn speaker and being in the range generally between $4\times10^{-2}$ meters/newton to $4\times10^{-4}$ meters/newton, and a back cover secured to said housing to form an air space on the side of said diaphragm opposite said phasing plug, said back cover being lined with a sound absorbing material and said air space behind said diaphragm being of a size substantial enough to permit free loadless displacement of said diaphragm during a backward excursion thereof.

12. The low distortion compression driver of claim 11 further comprising an annular sound absorbing element placed substantially behind said annular suspension member substantially opposite said gap.

13. A low distortion horn speaker comprising a casing assembly, an acoustical horn having a mouth end and a throat end, a voice diaphragm disposed in said casing assembly so as to be air coupled to the throat end of said acoustical horn, said throat end of said acoustical horn being sized to provide a throat resistance which substantially dominates the radiation resistance of said diaphragm substantially over the frequency range of said horn speaker, a diaphragm suspension means for suspending said diaphragm from said casing assembly, the compliance of said diaphragm suspension means being relatively high sustantially over the frequency range of said speaker wherein, when said diaphragm is operating in the presence of the dominating throat resistance of said acoustical horn, any vibratory movement of said diaphragm, whether defined by one or more single frequency tones substantially within the frequency range of said speaker, is characterized by substantially force determinative diaphragm excursions as opposed to substantially linear displacement excursions whereby the vibratory movement of said diaphragm tends to compensate for the non-linear behavior of air pressure waves otherwise produced by a linearly vibrating diaphragm thereby reducing distortion in said air pressure wave and hence in the sound produced thereby, and means for imparting vibratory movement to said voice diaphragm in response to an externally supplied audio frequency electrical signal.

14. The low distortion horn speaker of claim 13 wherein an air space is provided on the side of the voice diaphragm opposite the throat of said acoustical horn, said air space being of a size substantial enough to permit substantially free loadless displacement of said diaphragm during a backward excursion thereof.

15. The low distortion horn speaker of claim 13 wherein the compliance of said diaphragm suspension means is in a range generally between $4\times10^{-2}$ meters/newton to $4\times10^{-4}$ meters/newton.

16. The low distortion horn speaker of claim 13 wherein said high compliance suspension means includes a substantially annular suspension member secured at its inner circumference about the periphery of said voice diaphragm and secured at its outer circumference to said casing assembly.

17. The low distortion horn speaker of claim 16 wherein said high compliance suspension member is made of a soft rubber material.

18. The low distortion horn speaker of claim 16 wherein said high compliance suspension member is made of a flexible plastic material.

19. The low distortion horn speaker of claim 18 wherein said high compliance annular suspension member has material removed therefrom so as to form openings spaced about the annular suspension member's circumference whereby increased compliance of said suspension member is achieved.

* * * * *

UNITED STATES PATENT AND TRADEMARK OFFICE

CERTIFICATE OF CORRECTION

PATENT NO. : 4,152,552

DATED : May 1, 1979

INVENTOR(S) : John D. Meyer

It is certified that error appears in the above—identified patent and that said Letters Patent is hereby corrected as shown below:

Column 1, line 56, "impedence" should read -- impedance --.

Column 3, line 60, "constrast" should read -- contrast --.

Column 6, line 54, "goverened" should read -- governed --.

Column 8, line 23, "34d" should read -- 3rd --.
line 35, "indicate" should read -- indicated --.
line 47, "to the" should read -- of the --.

Column 9, line 13, after "casing" insert -- assembly --.

Signed and Sealed this

*Eleventh* Day of *December 1979*

[SEAL]

*Attest:*

SIDNEY A. DIAMOND

*Attesting Officer*

*Commissioner of Patents and Trademarks*